US005090584A

United States Patent [19]

Roberts et al.

[11] Patent Number: 5,090,584

[45] Date of Patent: Feb. 25, 1992

[54] MULTI-FUNCTION CUP LID

[75] Inventors: Clifford J. Roberts, Mullica Hill, N.J.; Edward Batson, Tempe; John H. Kurz, Scottsdale, both of Ariz.

[73] Assignee: Scott Paper Company, Philadelphia, Pa.

[21] Appl. No.: 661,217

[22] Filed: Feb. 27, 1991

[51] Int. Cl.[5] ..... B65D 43/06

[52] U.S. Cl. ..... 220/712; 220/268

[58] Field of Search ..... 220/90.2, 90.4, 90.6, 220/229, 266, 335, 355, 268

[56] References Cited

U.S. PATENT DOCUMENTS

| | | | |
|---|---|---|---|
| D. 267,633 | 1/1983 | Christian . | |
| D. 274,502 | 7/1984 | Little . | |
| 3,227,330 | 1/1966 | Sadler . | |
| 3,442,416 | 5/1969 | Nicholson . | |
| 3,923,193 | 12/1975 | Wells et al. | 220/269 |
| 3,977,559 | 8/1976 | Lombardi | 220/90.4 |
| 3,994,411 | 11/1976 | Elfelt et al. . | |
| 4,056,210 | 11/1977 | Boyle | 220/90.4 |
| 4,090,660 | 5/1978 | Schram et al. | 220/90.2 X |
| 4,202,459 | 5/1980 | DeParales et al. . | |
| 4,210,272 | 7/1980 | Sequin . | |
| 4,253,582 | 3/1981 | Shields . | |
| 4,285,442 | 8/1981 | Wedzik | 220/270 |
| 4,322,015 | 3/1982 | Bailey . | |
| 4,460,103 | 7/1984 | Rama et al. . | |
| 4,473,167 | 9/1984 | Bailey . | |
| 4,502,608 | 3/1985 | Mills | 220/90.4 |
| 4,629,088 | 12/1986 | Durgin . | |
| 4,738,373 | 4/1988 | DeParales . | |
| 4,741,450 | 5/1988 | Braude | 220/90.4 |
| 4,796,774 | 1/1989 | Nabinger | 220/90.4 |
| 4,949,865 | 8/1990 | Turner | 220/90.4 |
| 4,966,294 | 10/1990 | Mack et al. | 220/266 |

*Primary Examiner*—Gary E. Elkins
*Assistant Examiner*—Vanessa Caretto
*Attorney, Agent, or Firm*—John W. Kane, Jr.; Mark G. Bocchetti

[57] ABSTRACT

Disclosed is a disposable container lid for releasably mounting to a disposable container. The lid includes a central portion having a rim engaging means about the circumference of the central portion. An access strip is provided by a pair of tear impressions extending from the rim engaging means to a hinge means located in the central portion. By breaking the tear impressions, the access strip can be pivoted back from the hinge means to create an access opening through the lid. The central portion of the lid has a primary slit therein which is preferably arcuate. At each end of the primary slit there is a tab forming slit, each forming an inwardly directed retaining flap. A deflection flap is formed by the combination of the primary slit and the tab forming slits. To lock the access strip in a non-interfering position, it is folded back and pushed against the central portion of the lid thereby causing the deflection flap to deflect down toward the contents of the container. The small retaining flaps spring past the sides of the access strip and thus overlap such sides holding the access strip in abutting, face-to-face position with the deflection flap. The access strip can be released from the retaining flaps merely by directing upward force against the access strip causing the retaining flaps to deflect upward and spring past the access strip. The access strip can then be reseated on the rim of the cup if desired.

13 Claims, 2 Drawing Sheets

MULTI-FUNCTION CUP LID

BACKGROUND OF THE INVENTION

1. Field of the Invention

This invention relates generally to disposable beverage container lids and more particularly thin, thermoplastic polymeric lids of the type conventionally employed as temporary closures for food and beverage containers wherein such lid includes a flap or tear strip which may be folded back to allow drinking access from the container without removing the entire lid.

2. Brief Description of the Prior Art

The typical cup or beverage container lid is generally comprised of a thin, resilient polymeric material which includes a relatively flat central portion which nests within and below the rim of the cup or container and a rim-engaging means that is adapted to engage the container rim in a releasable manner. Conventionally, drinking access is achieved by either removing the lid from the container or by providing the lid with an access flap or tear strip. Such access flap or tear strip is usually provided through the use of tear impressions which begin on the central portion of the lid in relatively close proximity to one another and extend outward to or through the point where the lid engages the cup rim.

U.S. Pat. No. 4,322,015 to Bailey teaches a cup lid of the type described above which further includes at least one molded-in protrusion extending up from the central portion of the container lid adapted to releasably engage the rim engaging portion of the access strip when such access strip has been released from the cup rim and folded back.

U.S. Pat. No. 3,994,411 to Elfelt et al. teaches yet another disposable cup lid which includes a drinking flap or access strip. When such drinking flap is pivoted back from the cup rim to allow access to the contents of the cup, Elfelt uses a pull tab extending from the flap which may be laced through the straw slits in the central portion of the cup lid to retain the flap in open position.

U.S. Pat. No. 4,629,088 to Durgin teaches still another disposable container lid with a drink through opening. In order to retain the drinking flap in open position, Durgin employs a recess formed in the lid surface which has protruding therein a plurality of detents for engaging the drinking flap when it is pivoted down into such recess.

There is taught in U.S. Pat. No. 4,473,167 to Bailey still another disposable container lid which includes an access strip. With this strip, Bailey teaches a molded-in depression in which the access strip can be retained when it is pivoted back from the cup lid into such depression.

In U.S. Pat. Nos. 4,738,373 and 4,202,459, DeParales teaches disposable container lids with access flaps. Each lid taught in such references includes an arcuate recess adapted to compressively receive and retain therein the rim engaging portion of the access flap thereby holding such flap in open position.

From the foregoing, it can be seen that the prior art has relied predominately on molded in depressions or protrusions in the cup lid to retain the access flap in an open and non-interfering position. The principal exception to this is the above-referenced patent Elfelt which relies on a planar extending pull tab which must be laced through the straw slits in the cup lid to retain the access flap in open position. Nothing in the prior art teaches means for retaining the access flap in open position without adding more polymeric material to the lid to form such planar pull tabs, molded-in protrusions and molded-in depressions.

SUMMARY OF THE INVENTION

It is therefore an object of the present invention to provide a disposable container lid with an access flap and a means for retaining said access flap in an open and non-interfering position.

It is another object of the present invention to provide an improved disposable container lid wherein the means for retaining the access flap in open position comprise at least one V-shaped slit in the surface of the cup lid.

Another object of the present invention is to provide a container lid having the access strip which may be folded back and retained in an open and non-interfering position or, alternatively, removed entirely from the container lid.

Briefly stated, the foregoing and numerous other objects, features and advantages of the present invention will become readily apparent upon a reading of the detailed description, claims and drawings set forth herein. These objects, features and advantages are accomplished through the manufacture of a cup lid which includes an arcuate slit in the central portion thereof located inward from the hinge means of the access flap. The hinge means of the access strip is substantially equal distance from the arcuate slit and the rim engaging means of the access flap. Located near each end of the arcuate slit is a V-shaped slit wherein the points of the V's are directed substantially radially inward toward the central portion of the cup lid.

The access strip is formed by tear impressions in the lid surface extending substantially radially inward from the rim engaging means of the cup lid. The access strip is opened by breaking such tear impressions and pivoting the strip at the hinge means. To retain the access strip in an open and non-interfering position, the access strip is pushed downward against the central portion of the lid thereby deflecting the flap that is created between the arcuate slit and the two V-shaped slits. The two V-shaped slits give rise to two V-shaped flaps which spring past the side edges of the access strip when the access strip is sufficiently depressed against the central portion of the lid. Once said V-shaped flaps spring past the sides of the access flap, they partially overlap such sides thereby retaining the access flap in an open and non-interfering position.

DETAILED DESCRIPTION OF THE PREFERRED EMBODIMENT

Figure 5:
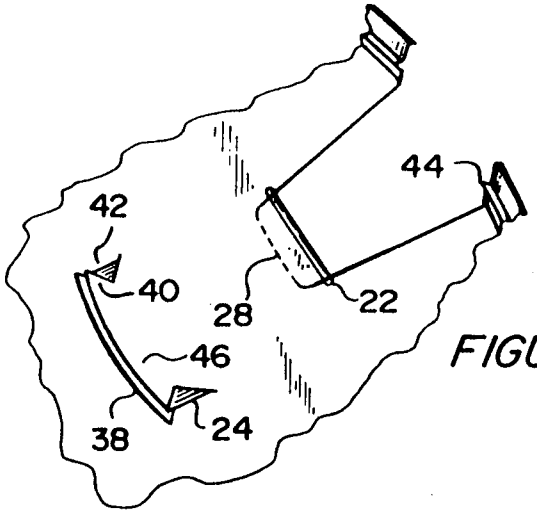
FIG. 5 is a perspective view of a portion of the underside of the container lid of the present invention with the access flap loacked back.
Figure 1:
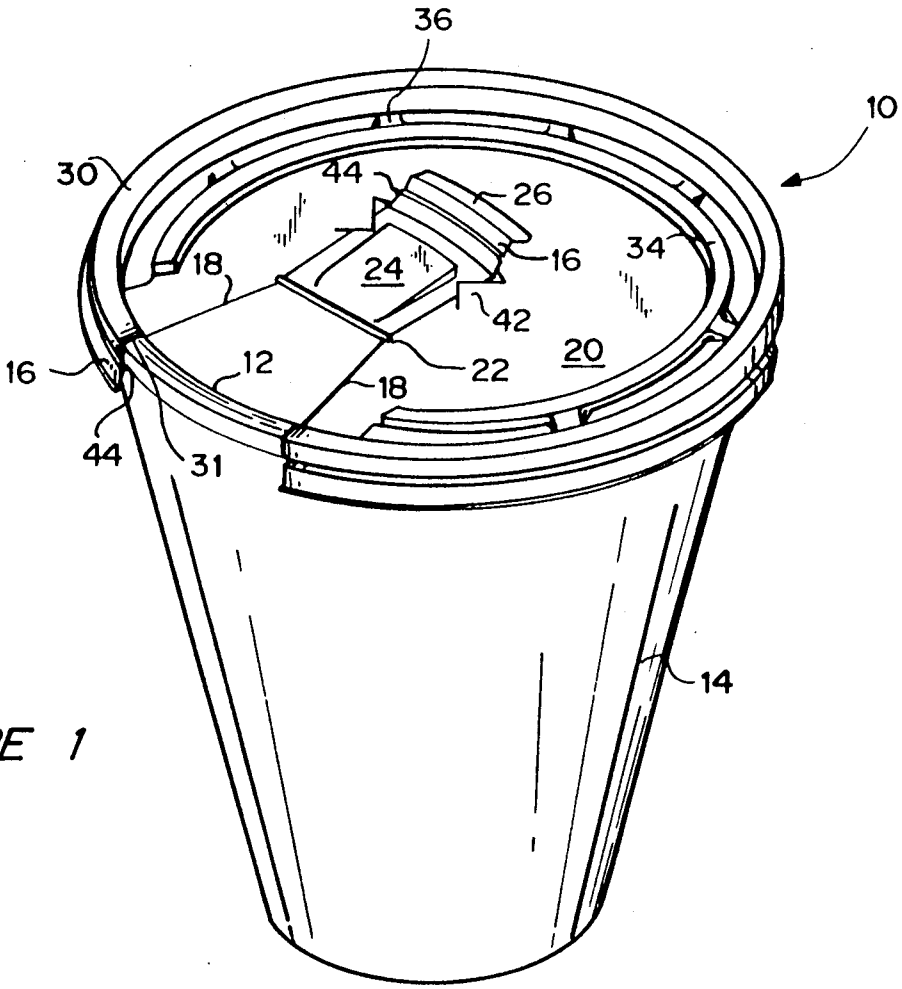
FIG. 1 is a perspective view of the disposable container lid of the present invention mounted on a cup.
Figures 2, 3, 4:
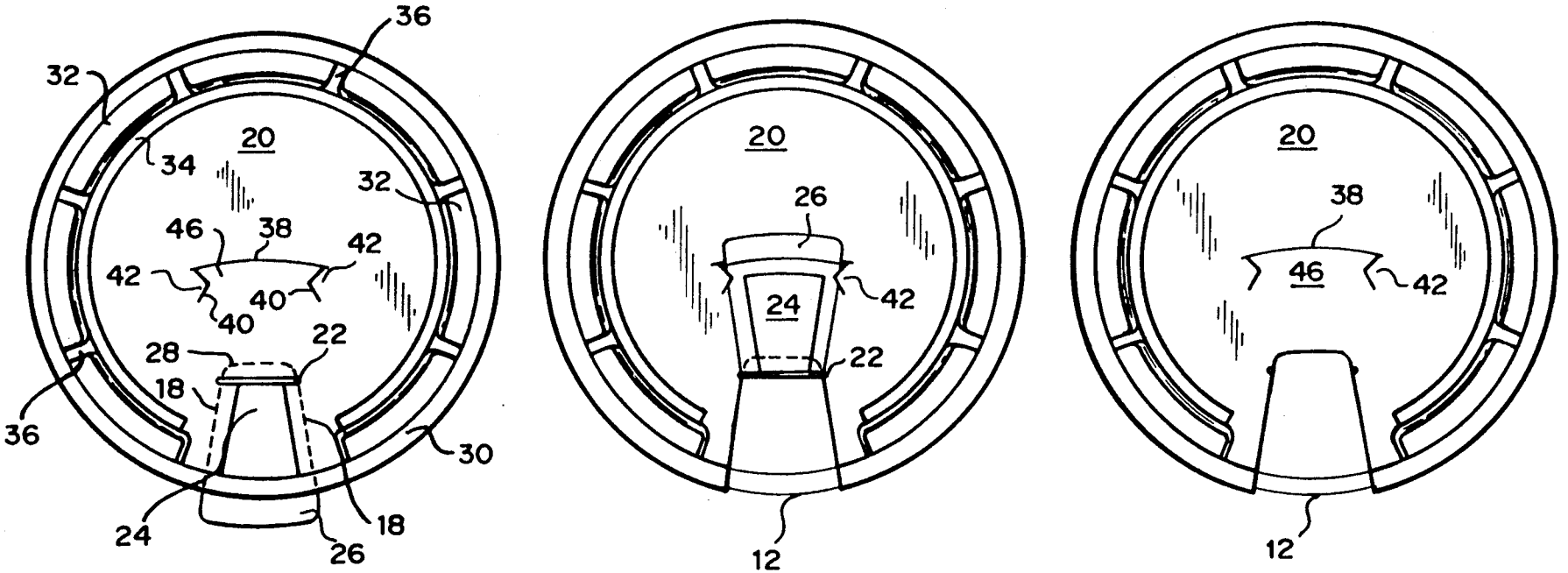
FIG. 2 is a top plan view of the disposable container lid of this present invention with the access strip in the closed position.
FIG. 3 is a top plan view of the disposable container lid of the present invention with the access strip retained in an open position.
FIG. 4 is a top plan view of the disposable container lid of the present invention with the access strip removed.

Referring now to FIGS. 1 through 4, there is shown the disposable container lid 10 of the present invention which is formed from a thin sheet of resilient, polymeric material as is typical for disposable container lids of this type and well known in the art such as, for example high impact polystyrene. The container lid 10 releasably attaches to the rim 12 of a disposable cup 14. The disposable cup 14 is typically made of polystyrene.

The lid 10 includes an annular, peripheral skirt 16 extending substantially downward from the circumferential edge of the lid 10. The lid 10 is provided with a pair of tear impression 18 which begin in the central portion 20 of the lid 10 and extend substantially radially outward through the skirt 16. The tear impressions 18 extend inward to hinge 22. Hinge 22 is a thin, molded-in recess or depression in central portion 20. Access strip 24 is the area in between tear impressions 18. Extending from skirt 16 of access flap 24 is pull tab 26. On the opposite side of hinge 22 from tear impressions 18 is tear impression 28. Tear impression 28 is substantially arcuate or a widened U-shape such at the end points of the U align with, and are substantially co-linear with tear impressions 18.

Lid 10 is provided with an annular ridge 30 from which skirt 16 extends. The molding-in of annular ridge 30 creates inverted annular trough 31 thereunder adapted to receive rim 12 of cup 14. Located concentrically within annular ridge 30 is substantially annular channel 32. Annular ridge 30 extends completely about the circumference of the lid 10 including the access strip 24. Annular channel 32 preferably does not extend through the access flap 24.

Projecting upward from center portion 20 and located concentrically within substantially annular channel 32 is annular projection 34. There are a plurality of stiffeners 36 molded into lid 10 within substantially annular channel 32 at spaced apart locations such that stiffeners 36 extend radially inward from annular ridge 32 to annular projection 34. Stiffeners 36 and annular projection 34 add structural rigidity to lid 10.

Located in the central portion 20 of the cup lid 10 is an arcuate slit 38. The radius of arcuate slit 38 is at least slightly greater than the radius of cup lid 10. Located at each end of arcuate slit 38 is a V-shaped slit 40. V-shaped slits 40 create V-shaped flaps or tabs 42 within central portion 20.

Cup lid 10 of the present invention may be press fit onto the rim 12 of cup 14. Skirt 16 and inverted annular trough 31 are part of a rim engaging means which also includes an annular convexity 44 extending inward toward cup 14. Note that access flap 24 also includes a skirt portion 16 with a continuation of annular convexity 44 projecting inward therefrom. Because lid 10 is made from a thin, resilient, polymeric material and because the inside diameter of annular convexity 44 is slightly less than the outside diameter of rim 12, annular convexity 44 releasably engages rim 12. In such manner, lid 10 can be completely removed from cup 14 if desired.

If the user of the cup lid 10 desires to leave the cup lid 10 in place while gaining access to the contents within cup 14, he need merely lift pull tab 26 thereby breaking tear impressions 18 and separating access strip 24 from lid 10 along such tear impressions 18. In such manner, access strip 24 can be folded back at hinge 22 thereby leaving the user with an opening for access to the contents of the container 14. Because cup lid 10 is made of a resilient polymeric material, access strip 24 has a tendency to reside in a more or less upright position once tear impressions 18 have been broken and access strip 24 has been folded back. In such a position, strip 24 would create an obstruction to the user should he wish to drink from the container 14 by raising the container to his mouth to drink through the access opening. To retain access 24 in a non-obstructing position, the user need only push the folded-back access strip 24 downward against the central portion 20 of the lid 10 thereby deflecting primary or deflection flap 46 and V-shaped flaps 42 downward. As access strip 24 is pushed downward against flap 46, V-shaped flaps 42 deflect down and then snap past the sides of access strip 24. In such position, V-shaped flaps 42 retain access strip 24 in a locked position against the central portion 20. (See FIG. 3).

In order to reseal access 24 on container 14, the user need only pull up on the pull tab 26 causing V-shaped flaps 42 to deflect upward and snap past access strip 24. Access strip 24 is thus placed, once again, into an unlocked position. The skirt portion 16 of access strip 24 may then be reseated about rim 12 such the access strip portion of annular convexity 44 once again engages rim 12.

With the use of tear impression 28, the user has the option of removing access strip 24 entirely. Once tear impressions 18 have been broken, then user can exert greater upward force on pull tab 26 and access strip 24 to rip through hinge 22 to reach tear impression 28. In such manner, tear impression 28 can then also be broken thereby completely separating access strip 24 from lid 10.

It should be recognized that slit 38 need not be arcuate. Rather, slit 38 could be a straight line or a plurality of connected straight line segments. The principal requirement of slit 38 is that it be located such that the distance from hinge 22 to slit 38 is slightly greater than the distance from hinge 22 to the outside of the skirt portion 16 of access strip 24. Further, slit 38 should be longer than the width of the skirt portion 16 of access strip 24. In such manner, access strip 24 can be pressed against primary flap 46 and V-shaped flaps 42 without interference from any other part of central portion. It should also be understood that slits 40 and 42 are not limited to being V-shaped. Any slit geometry which forms relatively small opposing tabs which overlap the sides of a folded back access strip 24 would be acceptable. Further, it should be recognized that a single container flap 42 might be used so long as it overlapped access strip 24 sufficiently to lock down access strip 24 against deflection flap 20.

Slits 38 and 40 and flap 46 serve a dual function. Not only do slits 38 and 40 and access flap 46 create a lock-down means for retaining access strip 24 in a non-interfering position, slits 38 and 40 and flap 46 also serve as a straw access opening. Should the user desire to obtain access to the contents of container 14 through the use of the straw without utilizing access strip 24, he may insert a straw through the opening created in central portion 20 by deflection or primary flap 46.

From the foregoing, it will be seen that this invention is one well adapted to attain all of the ends and objects herein above set forth together with other advantages to which are apparent and which are inherent to the device.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

What is claimed is:

1. A container lid for releasable mounting to a disposable container comprising:
(a) a central portion;
(b) an inverted annular trough surrounding said central portion;
(c) a skirt extending about said inverted annular trough;
(d) a hinge means located in said central portion;
(e) a pair of tear impressions extending from said inverted annular trough to said hinge means;
(f) a primary slit in said central portion;
(g) a tab forming slit located at least at one end of said primary slit thereby creating at least one retaining flap.

2. A disposable container lid of thin, resilient, polymeric sheet construction for use with a container comprising:
(a) a substantially circular central portion;
(b) rim engaging means encircling said central portion for releasably affixing said lid to the container;
(c) an access strip in said lid extending from said rim engaging means to a hinge means located in said central portion;
(d) a primary slit in said central portion, said hinge means being between said primary slit and said rim engaging means;
(e) a tab forming slit located at each end of said primary slit thereby forming a deflection flap and a pair of retaining flaps.

3. A disposable container lid as recited in claim 2 further comprising:
a substantially annular projection extending up from said central portion and located substantially concentrically within the said rim engaging means.

4. A disposable container lid as recited in claim 3 further comprising:
a plurality of stiffeners extending substantially radially from said rim engaging means to said annular projection.

5. A disposable container lid as recited in claim 2 wherein:
said hinge means is thin depression molded into said central portion.

6. A disposable container lid as recited in claim 2 wherein:
said access strip is defined by a pair of primary tear impressions extending from said rim engaging means into said central portion, each of said primary tear impressions having an end near to said hinge means.

7. A disposable container lid as recited in claim 6 further comprising:
a secondary tear impression in said central portion, said hinge means residing between said primary tear impressions and said secondary tear impression, said secondary tear impression located in close proximity to said hinge means with said secondary tear impression beginning near said end of one of said primary tear impressions and terminating near said end of said other primary tear impression.

8. A disposable container lid as recited in claim 2, said rim engaging means is comprising:
(a) an annular ridge;
(b) a skirt extending down from said annular ridge;
(c) an annular convexity projecting inward from said skirt.

9. A disposable container lid as recited in claim 8 further comprising:
an annular recess located between said annular ridge and said annular projection.

10. A disposable container lid as recited in claim 2 further comprising:
a pull tab extending from said rim engaging means of said access strip.

11. A disposable container lid as recited in claim 2 wherein:
said primary slit and said tab forming slits form a deflection flap there between.

12. A disposable container lid as recited in claim 2 where:
said primary slit is arcuate.

13. A disposable container lid as recited in claim 2 wherein:
said tab forming slits are substantially V-shaped.

* * * * *